US006701831B2

(12) United States Patent
Jones et al.

(10) Patent No.: US 6,701,831 B2
(45) Date of Patent: Mar. 9, 2004

(54) APPARATUS AND METHOD FOR AUTOMATED BINDING AND SPOOLING OF WIRE CORES

(75) Inventors: Samuel E. Jones, Carthage, MO (US); Craig V. Millett, Granby, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/113,533

(22) Filed: Mar. 29, 2002

(65) Prior Publication Data

US 2003/0183093 A1 Oct. 2, 2003

(51) Int. Cl.[7] ..... B65B 13/02; B65B 13/24

(52) U.S. Cl. ..... 100/3; 100/7; 100/12; 100/25; 100/29

(58) Field of Search ..... 100/2, 17, 25, 100/29, 31, 32, 33 R, 1, 3, 4, 7, 12

(56) References Cited

U.S. PATENT DOCUMENTS

| | | | | |
|---|---|---|---|---|
| 3,104,126 A | | 9/1963 | Lovash | 294/97 |
| 3,129,658 A | | 4/1964 | Valente | 100/218 |
| 3,400,652 A | * | 9/1968 | Hill et al. | 100/7 |
| 3,548,739 A | | 12/1970 | Glasson | 100/7 |
| 3,583,311 A | | 6/1971 | Hill | 100/7 |
| 3,633,492 A | | 1/1972 | Gilvar | 100/3 |
| 3,675,568 A | | 7/1972 | Martelee | 100/7 |
| 3,678,845 A | | 7/1972 | Francois et al. | 100/4 |
| 3,788,210 A | | 1/1974 | Lingemann | 100/7 |
| 3,842,728 A | | 10/1974 | Elineau | 100/7 |
| 3,908,712 A | | 9/1975 | Paletzki | 140/1 |
| 3,921,510 A | | 11/1975 | Glasson | 100/7 |
| 3,974,761 A | | 8/1976 | Hill | 100/7 |
| 4,020,755 A | | 5/1977 | Böhlmark | 100/12 |
| 4,024,805 A | | 5/1977 | Glasson | 100/12 |
| 4,301,720 A | | 11/1981 | Elineau | 100/12 |

FOREIGN PATENT DOCUMENTS

| | | | |
|---|---|---|---|
| EP | 0 280 317 | 8/1988 | B65D/27/06 |
| FR | 2 375 128 | 7/1978 | B65H/65/00 |
| GB | 1 137 924 | 12/1968 | B65B/13/02 |
| JP | 62 78027 | 4/1985 | B65B/27/06 |
| JP | 07329925 | 12/1995 | B65B/27/06 |

OTHER PUBLICATIONS

International Search Report dated Jul. 31, 2003, PCT/US03/09683.

* cited by examiner

*Primary Examiner*—Allen Ostrager
*Assistant Examiner*—Jimmy Nguyen
(74) *Attorney, Agent, or Firm*—Grant D. Kang, Esq.; Robert C. Haldiman, Esq.; Husch & Eppenberger, LLC

(57) ABSTRACT

An apparatus for binding a transportable wire core including a binding table comprised of sections in spaced relation sufficient to allow passage between them of a binding wire, and a collapsible carrying spool having base members being in spaced relation sufficient to allow passage between them of a binding wires. The spool is positionable on the table such that the base members of the spool and the sections of the table are aligned in operative cooperation. Guide tracks have first sections attached to the table and in operative alignment between the spool base members and the table sections. Guide track second sections are translatable between a removed position that allows a wire core on a spool to be positioned on the binding tables and an engaged position that operatively engages the binding wire guide track first sections. The second guide track sections operatively align between the sections of the table and the base members of the spool. A binding wire tying head loops binding wire around the wire core through the guide track sections, tensions the binding wire between the sections of the table and the spool and into direct contact with the wire core, and finally cuts the binding wire and knots it.

29 Claims, 12 Drawing Sheets

APPARATUS AND METHOD FOR AUTOMATED BINDING AND SPOOLING OF WIRE CORES

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

1. Field of the Invention

This invention relates to the automated packaging of transportable spools of wire, most typically heavier gauges of wire such as bale binding wire.

2. Related Art

Wire is typically packaged and transported in spools. More precisely, lengths of wire are wound in spirals which form a cylinder as the wire accumulates. A central, axial empty space is also cylindrical so that the finished volume of wound wire is toroidal in shape. This packaging shape is generally maintained by radial binding straps or wires which pass through the central axial space and wrap around a cross section of the volume of wire to be bound in a radial loop which will prevent the wire from unwinding.

When commercial volumes of heavy gauge wire are spooled, the weight of such volumes of wire become an issue in handling, packaging and transporting the spools. For example, typical volumes of bulk material baling wire are too heavy to be moved, stored or transported without the use of machinery such as fork trucks. These bound toroids of wire, conventionally referred to as "cores," are difficult to handle by fork truck and may be damaged by fork truck handling, unless they are placed on a handling aide such as a pallet. Handling wire cores by pallet still necessitates placing the core on the pallet to begin with, and later removing it from the pallet for placement in a position for its ultimate use.

In other regards, there is a constant need in the industry for increasing the speed, automation, efficiency weight capacity of wire core binding, as for example, by incorporating electro servo motors into the binding process.

Apparatuses and methods for winding and binding wire into cores are known. See, for example, U.S. Pat. No. 3,129,658 to Valente; U.S. Pat. No. 3,908,712 to Paletzki; U.S. Pat. No. 3,583,311 to Hill et al.; U.S. Pat. No. 3,974,761 to Hill. Various wire binders are known, See U.S. Pat. No. 3,548,739 to Glasson; U.S. Pat. No. 3,675,568 to Martelee; U.S. Pat. No. 3,921,510 to Glasson; U.S. Pat. No. 4,024,805 to Glasson; U.S. Pat. No. 3,678,845 to Francois; U.S. Pat. No. 3,842,728 to Elineau; and U.S. Pat. No. 4,301,720 to Elineau. Various core handling devices have also been developed. See, U.S. Pat. No. 3,633,492 to Gilvar; U.S. Pat. No. 3,788,210 to Lingemann; and U.S. Pat. No. 4,020,755 to Bohlmark. None of these systems, however, solve the problem of handling and transporting the heavy wire cores output by these and other prior art machines. Moreover, prior art devices are limited in their speed and efficiency.

SUMMARY OF THE INVENTION

The present invention is an apparatus and method of wire core binding that produces a wire core integrated with a collapsible carrying spool specifically designed to facilitate the handling and transportation of the wire cores output on the spools.

The apparatus of the present invention receives an unbound, loose, uncompressed spiral of wire wound onto one of the novel, collapsible carrying spools of the present invention. A conveyor belt extends into a binding station where it deposits the loose wire "core" on its spool. Once in the binding station, the wire spiral is compressed by a compressor. While compression is still being applied, binding wire guide tracks close around the wire core to guide binding wire radially around the wire core. The guide tracks are aligned with gaps between compression plates. The binding wire is tightened, tied and released according to known techniques.

In a preferred embodiment of the present invention there are four binding wire guide tracks. Two binding wire tying heads use electro servo motors to simultaneously guide, tighten and bind two radial binding wires through two of the guide tracks. Thereafter, the tying heads rotate 90° where the other two guide tracks are used to guide, tighten and tie a third and a fourth binding wire around the wire core. The wire guide tracks are then removed from engagement with the wire core. Compression is released on the wire core, leaving it to remain compressed by the restraining binding wires. Finally, the bound, compressed wire core, still resting on its integrated collapsible carrying spool, is received by an extending exit conveyor by which it is removed from the binding station.

The present invention incorporates a novel spool for handling and transporting the wire core. The spool has horizontal base members and stand members whose vertical separation allows insertion of fork truck forks. Another novel aspect of the spool is that it has expandable and retractable contact members which work in cooperation with a central shaft having a handle. The cooperation of the contact members and shaft is such that the contact members expand to hold the wire core securely in place when the handle is lifted by an outside device such as a fork truck or an overhead hook. When lifting traction is released from the shaft, the contact members release their radial expansion contact with the wire core so that the core may be easily removed from the spool.

Further features and advantages of the present invention, as well as the structure and operation of various embodiments of the present invention, are described in detail below with reference to the accompanying drawings.

DETAILED DESCRIPTION OF THE PREFERRED EMBODIMENTS

Figure 1:
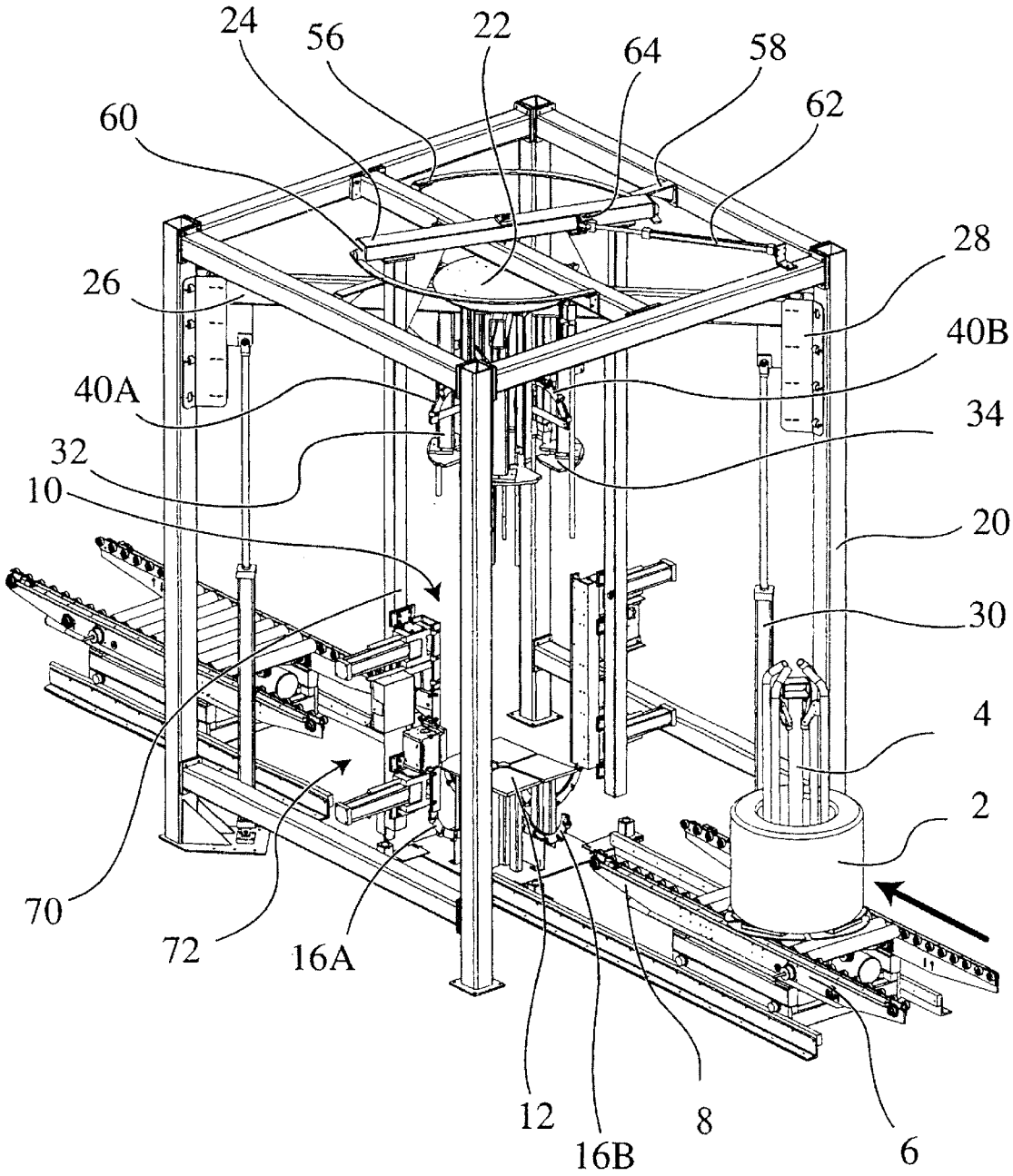
FIG. 1 is a perspective view of the wire core binding apparatus with the compressor and guide tracks elevated, before the wire core spool is inserted.

Referring to the accompanying drawings in which like reference numbers indicate like elements, FIG. 1 is a perspective view of the automatic wire core binder with integrated spool of the present invention. Unbound wire core, 2, having been previously wound onto wire core spool, 4, is carried along entry conveyor, 6, towards the apparatus. Entry conveyor, 6, incorporates extending arms, 8, which, upon arrival thereon of the wire core, 2, and spool, 4, extend beyond conveyor assembly, 6, to carry the wire core, 2, and spool, 4, into the binding station, 10.

Figure 2:
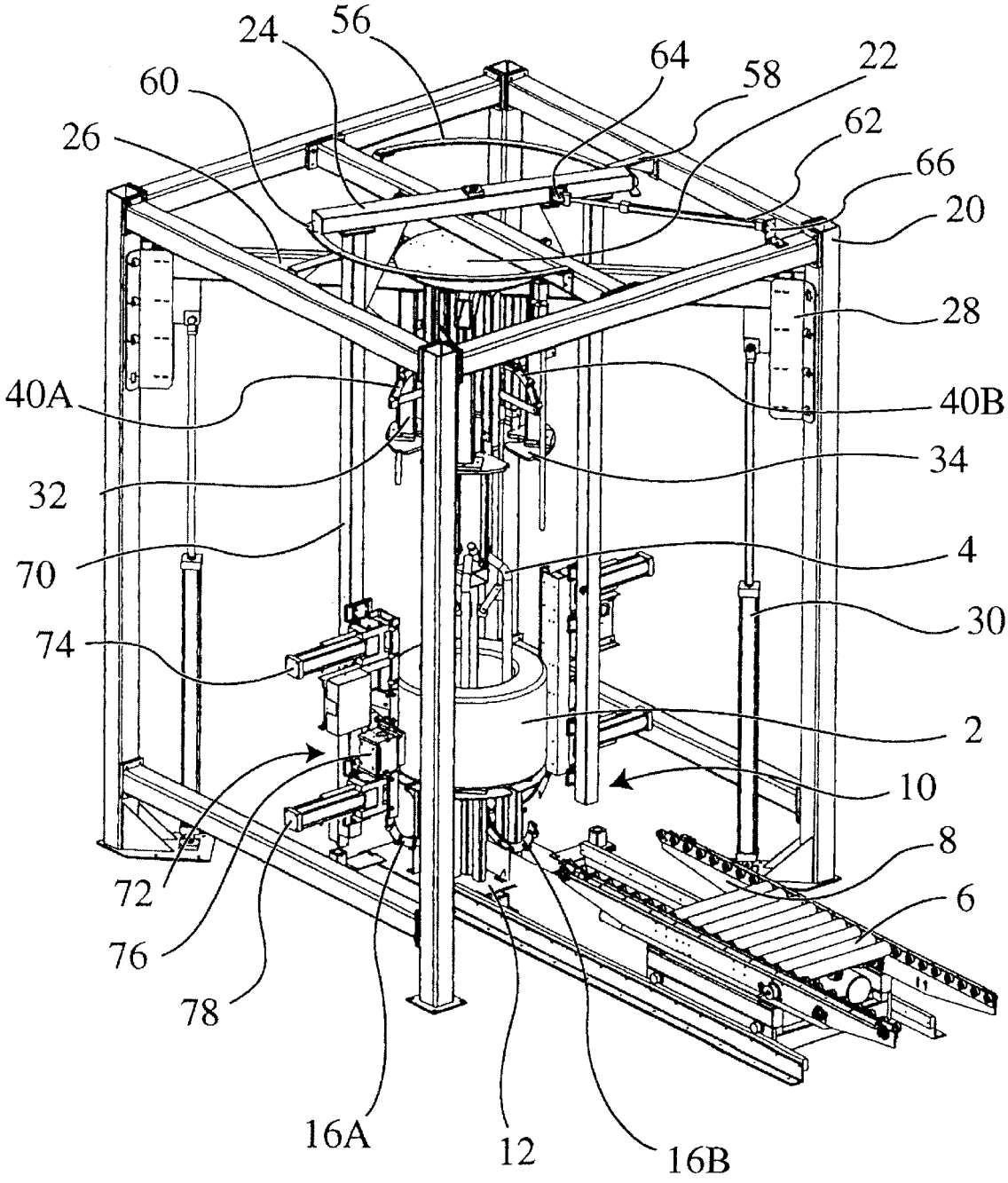
FIG. 2 is a perspective view of the wire core disposed within the binding station, with the compressor and guide tracks elevated.
Figure 3:
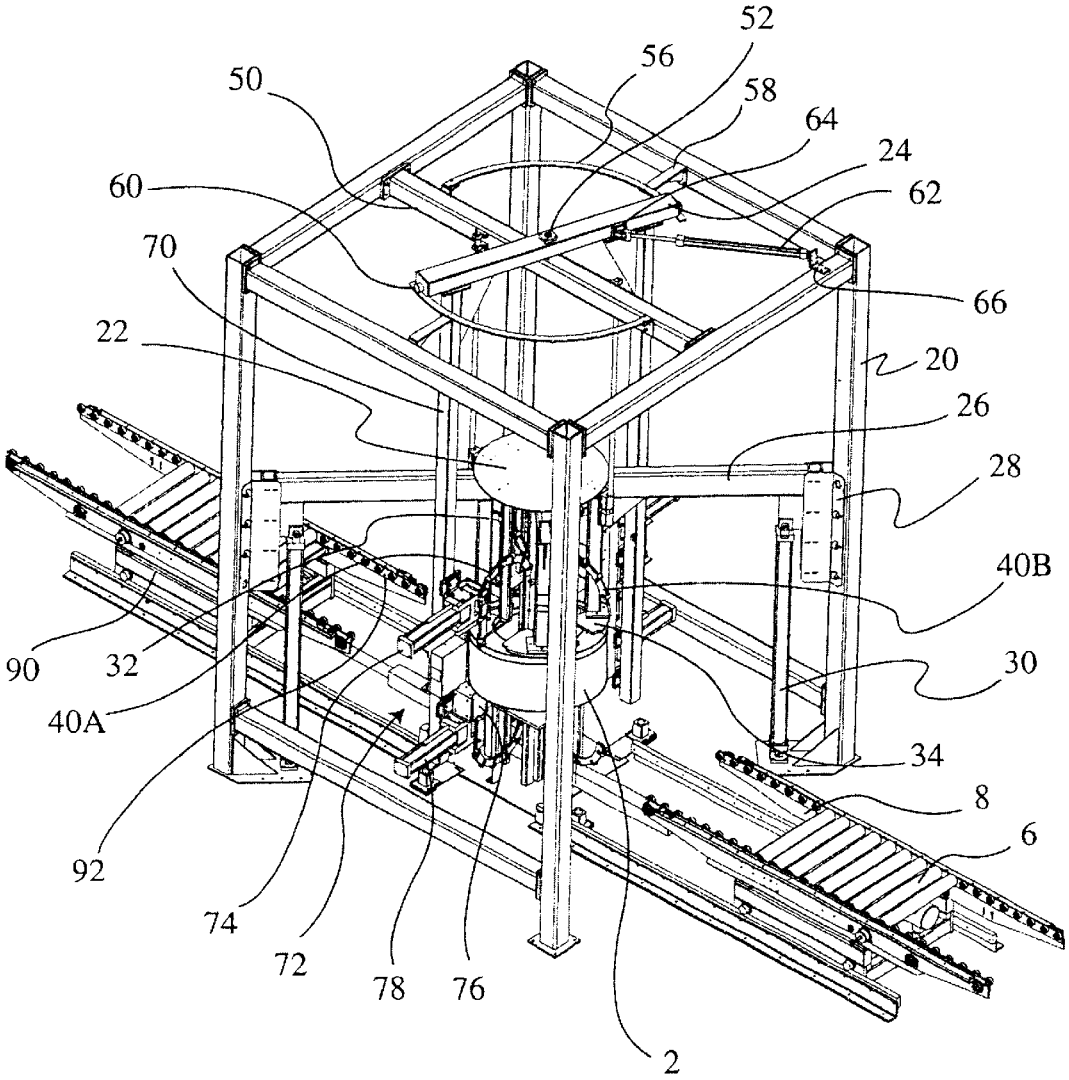
FIG. 3 is a perspective view of the wire core binding apparatus with the compressor and guide tracks engaged with the wire core.

In the binding station, 10, the wire core, 2, and carrier spool, 4, are placed on table, 12, by the extending arms, 8, of the conveyor belt, 6. The extending arms thereafter retract, leaving the core, 2, and the carrier spool, 4, on table, 12, as in FIGS. 2, 3 and 4.

Figure 6:
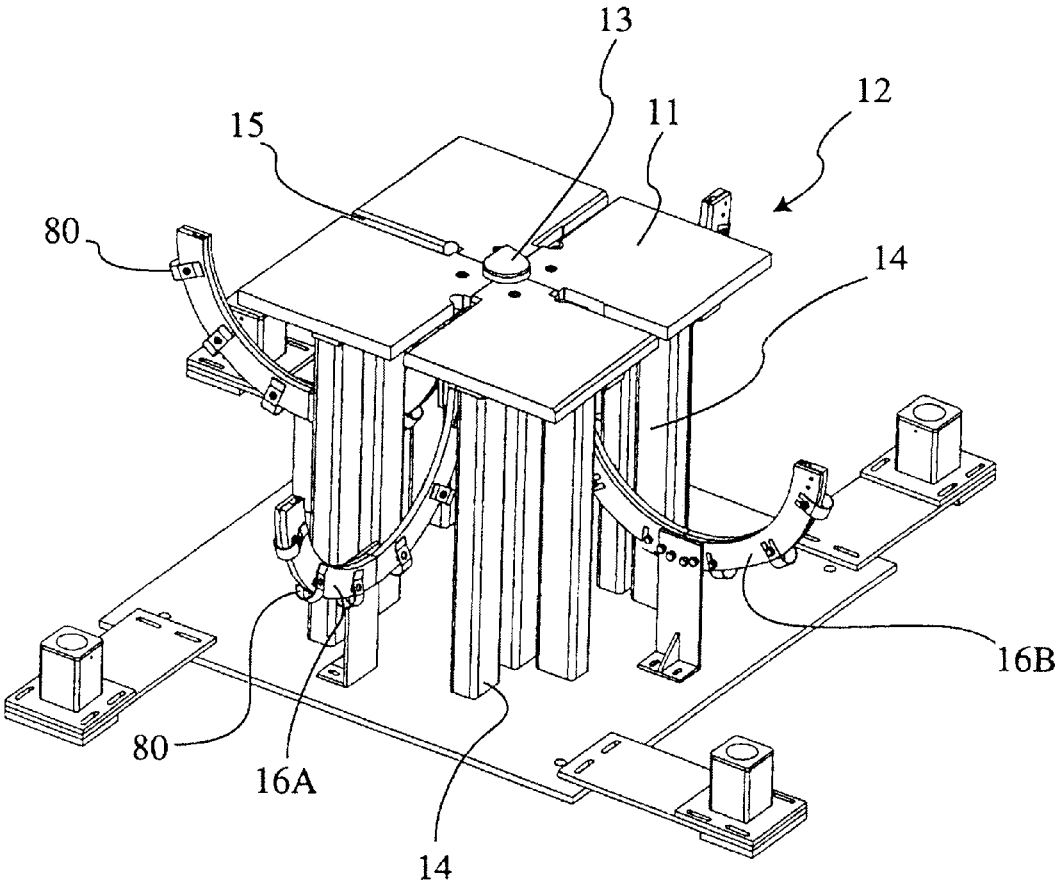
FIG. 6 is a perspective view of the binding table.

Table, 12, is comprised of separate components, preferably four in number as shown in FIG. 6. Each component is comprised of a table top section 11 and at least one leg 14. These four table top sections are disposed on a level plane, adjacent to one another but with a space between them. Accordingly, four gaps, 15, are left between the table top quadrants 11. These gaps are a path for the passage of a binding wire through the table top and between the table top quadrants.

Spool, 4, also has gaps, preferably four, that allow binding wire to pass through them. The spool is described more fully below. The spool gaps align with the table gaps. The table 12 and spool 4 will cooperatively receive the components that will descend through the center of the core, 2, during the binding and compression operation described more fully below.

To align the table 12 and spool 4, the table top has a locator pin, 13. The depicted embodiment has a central conical pin, 13, for properly centering the core spool on the table. Upon receipt of wire core, 2, and carrier spool, 4, the locator pin helps to assure the proper position of carrier spool, 4, so that its gaps align with the table gaps 15.

The table legs, 14, have lower guide track sections, 16A and 16B, as seen in FIGS. 1 and 6.

At least two techniques may be used to rotationally align the spool gaps with the table gaps, 15. One method uses at least one locator pin offset from the center of the table (not shown). Preferably a plurality of pins on the table top are received by holes in the spool bottom which are located in a position corresponding to proper gap alignment. The pins may be in the spool and holes in the table. Alternatively, the pins may retract and extend by known means, may be spring biased to extend, or may be fixed.

Figure 12:
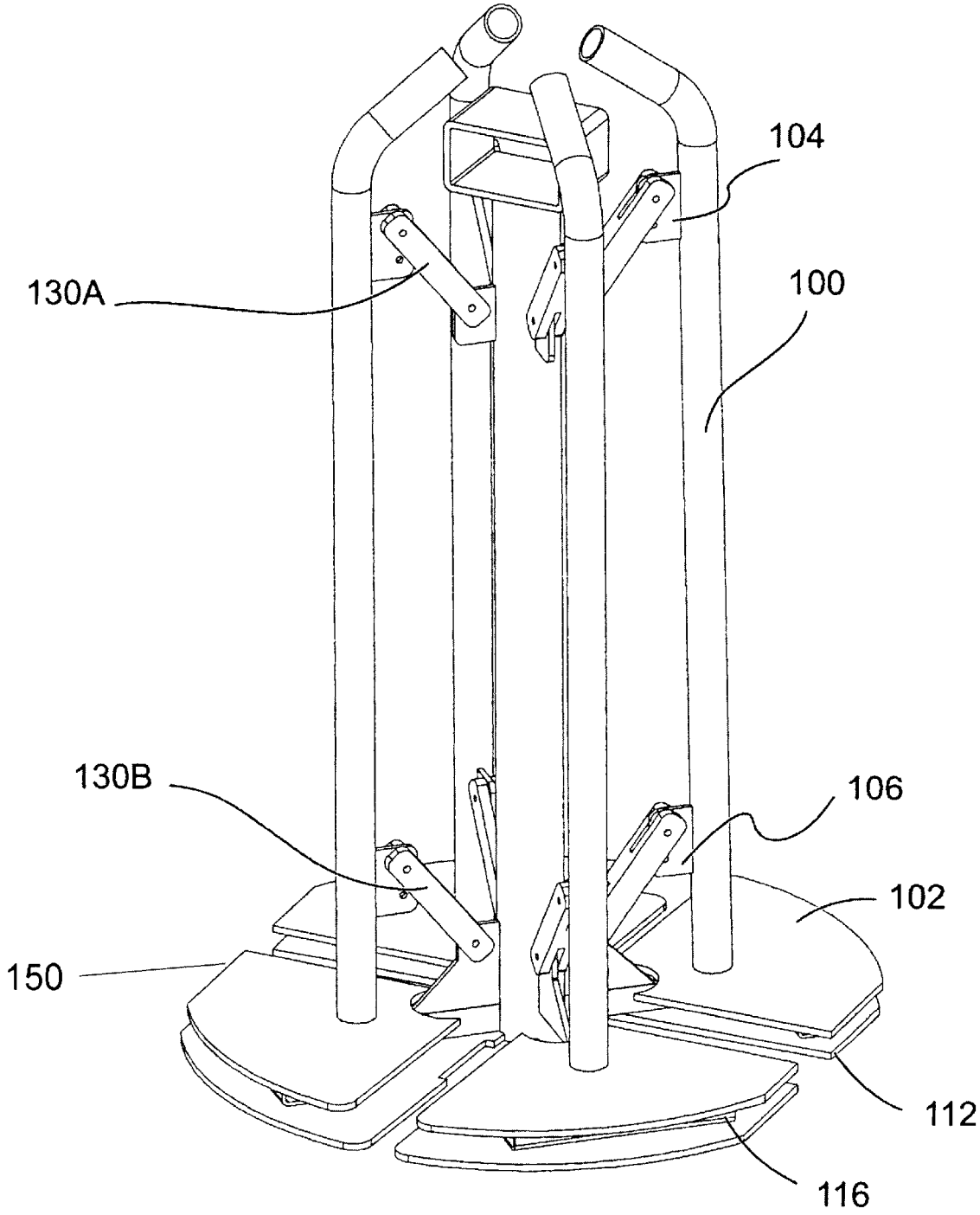
FIG. 12 is a perspective view of the collapsible spool with flat sides for alignment.
Figure 13:
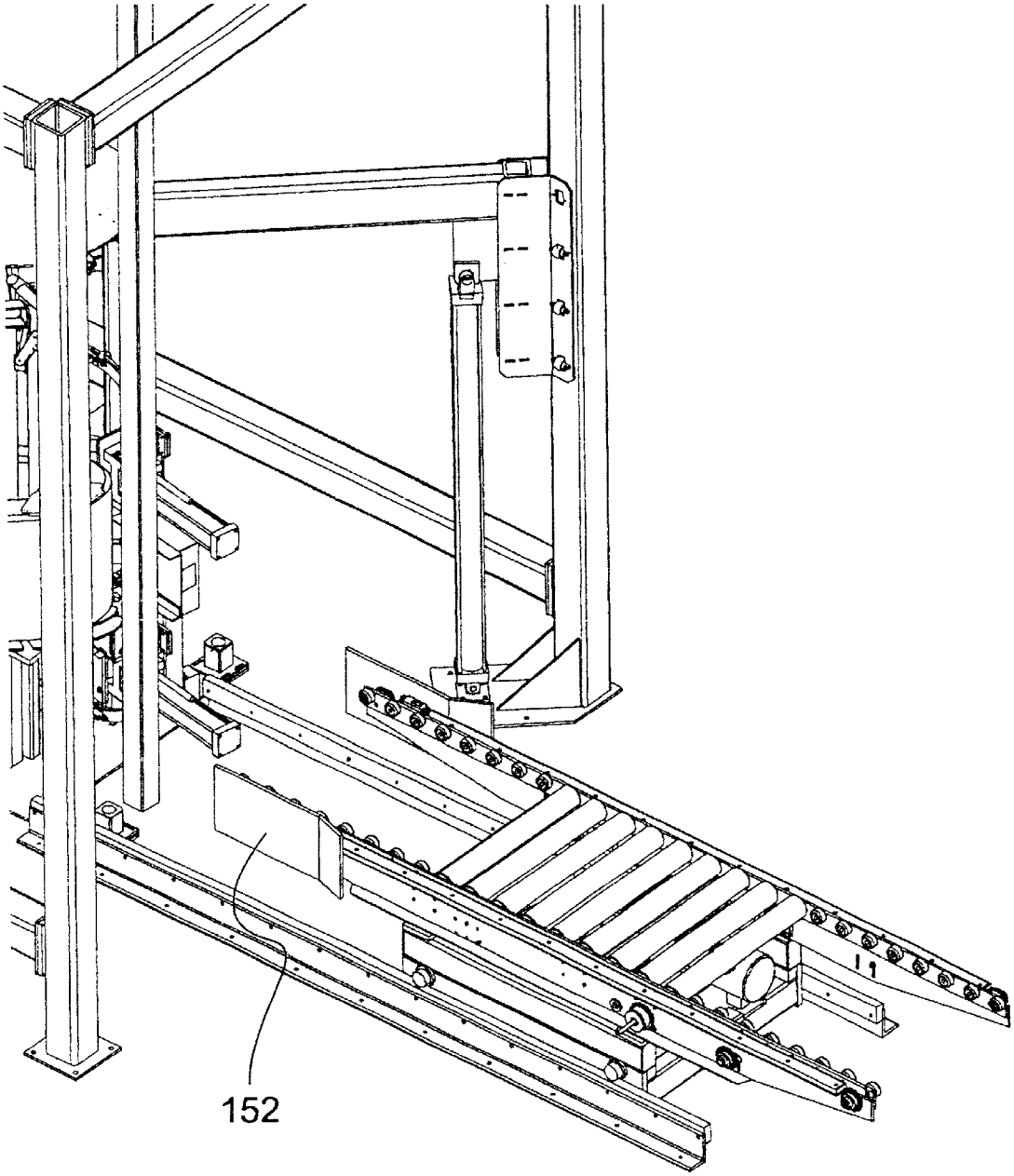
FIG. 13 is a close up view of the entry conveyor with side walls for alignment.

A second gap alignment technique is to configure the spool with straight edges on the sides and base, 150 in FIG. 12. The spool base is then dimensioned to slide down the entry conveyor with its straight edges in close sliding cooperation with sidewalls, 152 in FIG. 13, mounted on the conveyor. This configuration aligns the gaps parallel to the spool's line of travel down the conveyor. Gaps perpendicular to the long axis of the conveyor belt are then aligned by the conveyor extension arms. The arms are indexed to accurately place the spool on the table. Preferably the indexing is executed by a "cyclo" index box, in a known manner.

Disposed around the baling station is support frame, 20, as seen in FIGS. 1–4. Support frame, 20, is in a known, pre-determined spacing and alignment around table, 12. Preferably both table, 12, and frame, 20, are fixedly attached to a base plate or floor. Generally, support frame, 20, secures operational component assemblies, which are compressor, 22, and rotating tying head bracket, 24.

Compressor, 22, is slidably attached to two diagonally opposed vertical beams of frame, 20. Compressor boom, 26, is fixedly attached at either end to slide guides, 28 on frame 20. Compressor elevators, 30, lower the compressor, 22, to compress a wire core, as in FIGS. 1, 2, 3 and 4, and raise the compressor, 22, after the wire core has been bound. The compressor is in its raised position in FIG. 1. The top of compressor elevators, 30, are attached to compressor boom, 26, or slide guides, 28. The bottom end of compressor elevators, 30, are attached to frame, 20, although they may alternatively be attached to the floor. Compressor elevators, 30, may provide lift by any number of equivalent means including pneumatic power, hydraulic power or mechanical means.

Compressor, 22, includes compression arms, 32, and compression face plates, 34. Compression plates, 34, contact the wire core on its top surface and transfer the compressing force to the wire core, 2. Compression arms, 32, extend down vertically from where they are attached to compression boom, 26. Solid compression arms, 32, are of a preconfigured length in order to bring compression faces, 34, into contact with wire core, 2. Alternatively, they may be made variable in length by any conventional mechanical means, in order to accommodate wire cores of varying heights.

Figure 5:
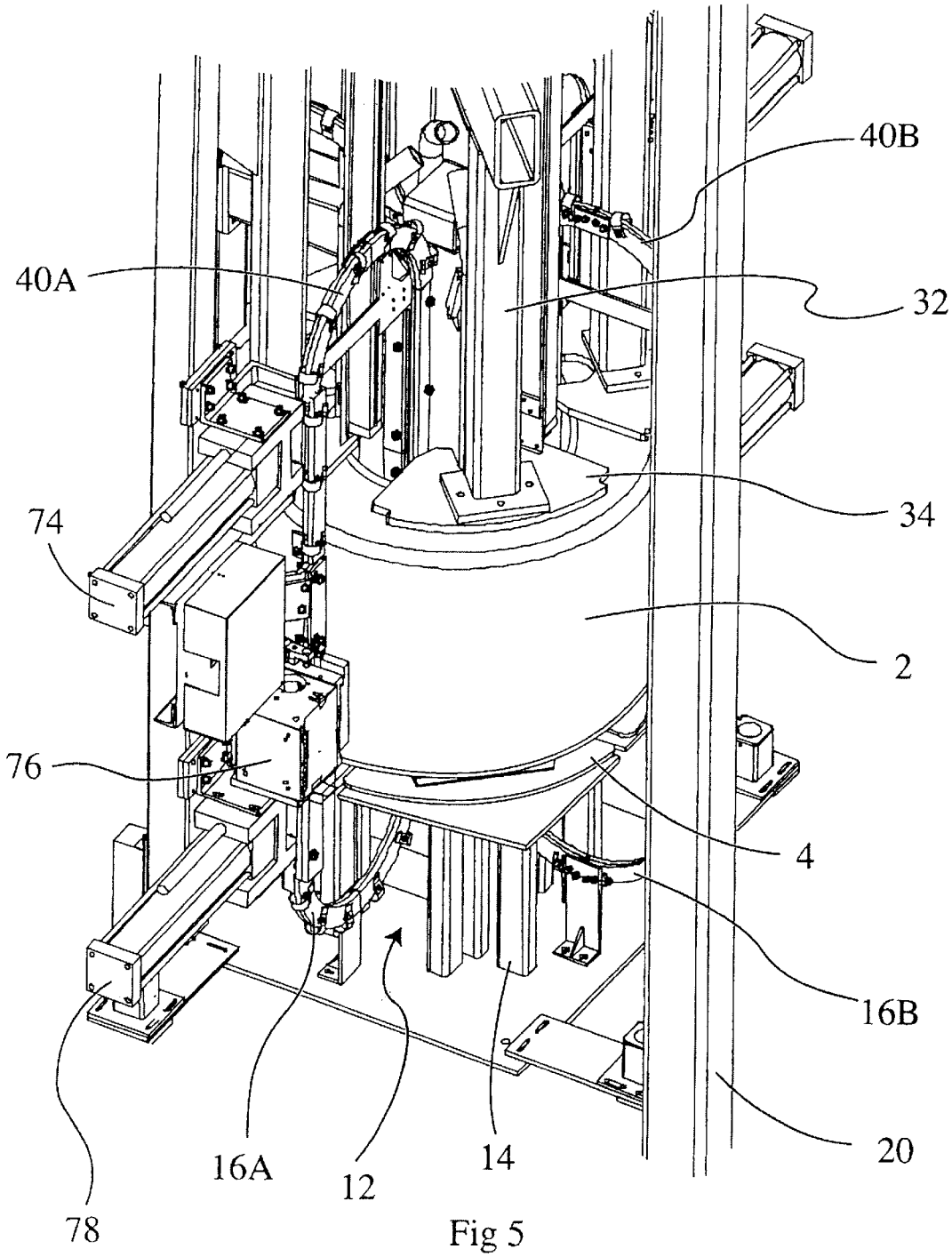
FIG. 5 is a closer perspective view of the wire core in the binding apparatus with the guide tracks and compressor engaged.

Also attached to compressor, 22, are four wire guide track upper sections, 40A and 40B, best seen in FIG. 5. Guide track upper sections, 40A and 40B, are for guiding the binding wire around the wire core. Each binding wire guide track section, 40A and 40B, is comprised of a straight, vertical interior section disposed to descend into the central, axial, open hole through the middle of the wire core. Binding wire guide track sections, 40A and 40B, are aligned to descend between vertical components of carrying spool, 4, described in detail below. Alternatively, binding wire guide track sections, 40A and 40B, may be further dimensioned to extend below the bottom surface of the wire core, 2, and below the bottom stand and base of the wire core carrier, 4, upon full decent of compressor, 22. Preferably, the interior vertical section of binding wire guide track sections, 40, are straight and the top portion is curvilinear, most preferably semi-circular. However, any shape is equivalent provided the binding wire guide track sections redirect a progressing binding wire from a vertical direction on the outside of the wire core, 2, to or from a vertical direction through the axial interior hole of the wire core, 2.

Also supported by frame, 20, is rotating tying head bracket, 24, best seen in FIGS. 1–4. The rotating tying head bracket's axis of rotation is coaxial with the wire core, 2, and carrying spool, 4. Support frame, 20, has a top central beam, 50. Substantially at the middle of beam, 50, is a pivot axis, 52, attached to beam, 50, and extending upwards therefrom into and through rotational fixation with the rotating tying head bracket top bar, 54. In the depicted embodiment rotating tying head bracket, 24, is designed to rotate 90°. The top tying head bar, 24, is guided and supported through its rotation by arcuate guide rails, 56, which are fixedly attached to support frame, 20, at brackets, 58. Top tying head bar, 24, is capped at its ends with wheels or bosses, 60, in rotating or sliding communication with guide rails, 56.

Rotation actuator, 62, is pivotally fixed to top tying head bar, 24, at bracket, 64, and pivotally fixed to support frame, 20, at bracket, 66. Rotation actuator, 62, may extend and contract pneumatically, hydraulically or mechanically. Extension and retraction of rotation actuator, 62, swings the tying heads, 72, around the circumference of the wire core, 2, allowing the tying heads, 72, to move from a first position to a second position. The first position is engaged with first and second binding wire guide tracks, 40A and 16A. The second position is engaged with third and fourth binding wire guide tracks, 40B and 16B. Preferably, the four binding wire guide tracks are 900 from one another, although other numbers of guide tracks and angles between them may be used.

Attached to top tying head bar, 24, and hanging downward from it are two tying head anchor bars, 70. Attached to the vertical anchor bars, 70, are tying head assemblies, 72, shown in detail in FIG. 5. The tying head assembly, 72, is comprised of a binding wire propulsion electro-servo motor, 74, a knotter, 76, a knotter actuator electro-servo motor, 78 and drive wheels, (not shown) and a gripper and a cutter (within knotter 76). Tying heads incorporating electro-servo motors are preferred, and most preferred are tying heads actuated through electro-servo motors and controlled by programmable logic circuits. However, a variety of binding wire and binding strap propulsion, guiding and fastening mechanisms are known in the art. Any of these mechanisms incorporated into the apparatus herein described is considered to be within the scope of the present invention. In FIG. 5 the tying heads, 72, are in their first position.

Binding wire looping, tightening and knotting operates as follows. Upon being brought into operative communication with one another, the tying head assembly, 72, and guide tracks, 16A and 40A, describe a substantially complete loop in a single vertical plane. The loop circumscribes the object to be bound, in this case the wire core, 2.

Binding wire guide track sections, 16A, 16B, 40A and 40B, are all comprised of two longitudinal guide track halves extending for the length of the guide tracks. The guide track halves are biased together by any of a variety of equivalent biasing means, conventionally by springs 80 exerting inward tension, as seen in FIG. 6. On the internal faces of at least one wire guide track half, facing the other half are concave grooves (not shown) which form a channel for receiving and guiding advancing binding wire while the guide track halves are biased together by the springs 80.

Once in place, binding wire propulsion electro-servo motor, 74, by means of drive wheels frictionally engaged with the binding wire (not shown) drives a length of the binding wire into and around the guide tracks, 16A, 16B, 40A and 40B. The pre-determined length of binding wire completes a loop around the wire core, 2. By means of a limit switch (not shown) or a programmable logic circuit control measuring the distance of wire travel through the guide track, the propulsion motor stops when the binding wire has completed the loop around the wire core, 2. Upon completing this loop, a cutter (not shown) cuts the proximal end of the binding wire.

Upon completing its loop around the wire core, 2, a gripper (not shown) grips the distal end of the binding wire and holds it fast. Thereafter, propulsion electro-servo motor, 74, reverses the direction of the drive wheels (not shown) in order put tension on the binding wire. Since the wire, through the guide track, is disposed in a loop around the wire core, 2, the tension exerts an inward force on the wire in the wire guide track channel. The propulsion motor, 74 exerts a pre-configured degree of tension sufficient to overcome the strength of the biasing springs 80 holding the two binding wire guide track halves together. When this pre-determined amount of tension overcomes the inward biasing strength of the springs, 80, the binding wire is pulled from the guide track and free of it. Once the wire is free of the guide track, the propulsion servo motor, 74, continues to apply reversing tension until the binding wire comes into tight, binding contact with the wire core, 2. Upon reaching a pre-configured tension, length, or other equivalent control means, the propulsion motor drive wheels continue to exert a pre-determined torque on the binding wire, holding it in binding contact with the wire core. At this point the binding wire is ready to be knotted.

Thereafter a knotter, 76, is propelled by a knotter propulsion electro-servo motor, 78, through a pre-configured number of gear rotations to twist the ends of the binding wire together to form a knot.

It will be noted that in the depicted embodiment the four wire core binding wires are applied to the wire core in pairs. The first pair is perpendicular to the line of travel of the conveyor belts. The second pair is parallel to the direction of the wire core's travel along the entry conveyor belt, 6, and the exit conveyor belt, 90. In order to maintain an open passageway into the baling station, 10, for entry and exit of the wire core and carrying spool, the rest position of the tying head assemblies, 72, is in the first position, perpendicular to the conveyor belt line of travel as in FIGS. 1, 2 and 3. This position is also in operative alignment with the first pair of binding wire guide tracks 16A and 40A.

After depositing the wire core in the baling station, 10, the extendible conveyor belt arms, 8, are retracted. This allows space for rotation of the binding wire tying head bracket in an arc that will bring the tying head assemblies, 72, into their second position, which is in operative engagement with the second pair of binding wire guide tracks, 16B and 40B, parallel to the conveyor belt line of travel.

Figure 4:
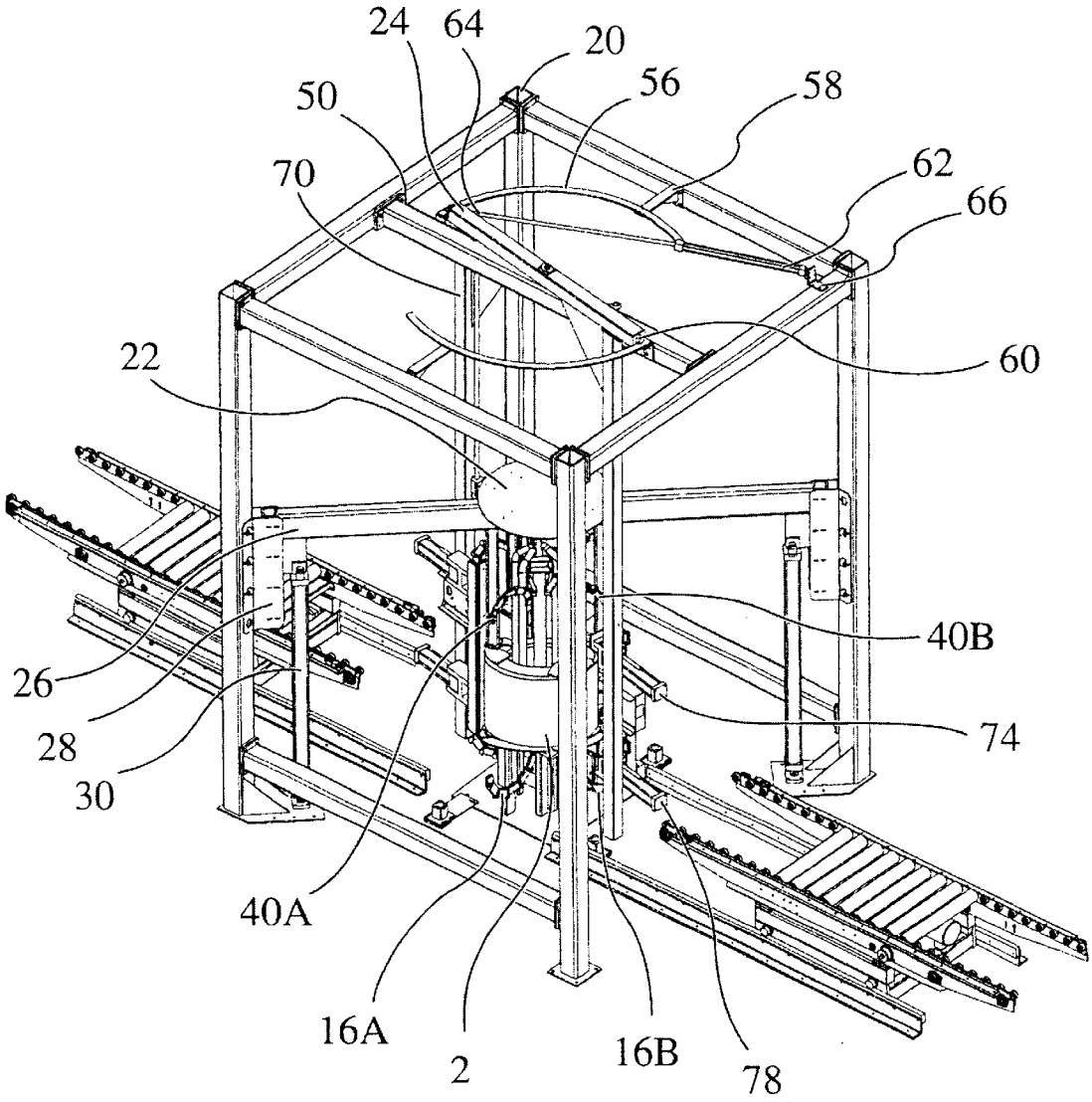
FIG. 4 is a perspective view of the wire core within the binding station with the compressor and guide tracks engaged with the wire core, and with the tying heads engaged with the wire core in a second position.

Accordingly, after finishing the looping, tightening, cutting and tying of the first pair of binding wires around the wire core, the tying head bracket, 24, rotates (in this embodiment in a counterclockwise direction from a perspective above the apparatus) in order to swing the tying head assemblies, 72, into operative engagement with the second pair of binding wire guide tracks, 40B and 16B, in the second position as seen in FIG. 4. After reaching operating engagement with the second pair of binding wire guide tracks 16B and 40B, the binding procedure for the second pair of binding wires is the same as that described for the first pair of binding wires, above. After the second pair of binding wires are looped, tightened, cut and knotted, the tying head bracket, 24, counter rotates (clockwise in this embodiment) back to its original position. Rotation of the tying head bracket, 24, is achieved by the action of rotation actuator arm, 62, which extends to push top tying head bar, 24, counterclockwise into its second position in alignment with the second pair of tying binding wire guide tracks, 40B and 16B. Thereafter rotation actuation arm, 62, retracts to pull top bar, 54, clockwise back into the first position, which is also the rest position, aligned with tracks 40A and 16A.

After all four binding wires have been tightened and tied around the wire core, the compression apparatus, 22, is raised which allows wire core, 2, to naturally expand, which expansion is immediately arrested by the binding wires, which now hold the wire core in its preferred compressed volume and shape.

It will be noted that in order for the binding wire to come into binding contact with the wire core after its tensioning and release from the binding wire guide tracks, the binding wire must have a free path to the core, uninterrupted by any pieces of the apparatus. Otherwise, any intervening apparatus piece would be bound to the core and the core could not be withdrawn from the apparatus. The four compression arms, 32, and four compression plates, 34, are separate from one another to provide a clear path to the wire core for the binding wire. As the binding wire is tensioned and drawn tight against the wire core it proceeds between each of the four compression plates, 34. Likewise, the binding wire is raised up through the table, 12, through the gaps 15 between the four quadrants 11 of the table's upper surface.

A novel aspect of the present invention is the design of the wire core collapsible carrying spool. It is integrated with the binding procedure and allows the wire core to be bound while on the carrying spool, having been previously deposited on the carrying spool. The collapsible carrying spool incorporates gaps in its base and stand layers, which gaps cooperatively align with the gaps in the top of the table, 12, and likewise allow passage therethrough of the binding wire in order that the binding wire directly contacts the wire core, 2, without binding in any unwanted parts of the apparatus, see FIGS. 7–11. The structure and the apparatus of the collapsible carrying spool are more fully described below.

After the binding wires have been tightened, knotted and cut, and after the tying head assemblies, 72, have rotated back to their rest positions perpendicular to the conveyor belts and after the compression apparatus, 22, has been lifted by extension of compressor apparatus lifting arms, 30, an exit path from the binding station, 10, is clear for removal of the wire core, 2, and collapsible carrying spool, 4. Accordingly, exit conveyor, 90, extends conveyor arms, 92, (See FIG. 3) into the binding station, 10, where they operatively engage the collapsible carrier spool, 4, in order to lift it from the binding table, 12, and withdraw it from the binding station, 10. Thereafter the combination of the bound wire core, 2, and collapsible carrying spool, 4, travel down exit conveyor, 90, to a position where they may be handled and transferred. This cycle repeats.

It will be evident to those of skill in the relevant arts that objects other than wire cores may be bound in the manner described herein without departing from the scope of the present invention.

Collapsible Carrier Spool

Figure 7:
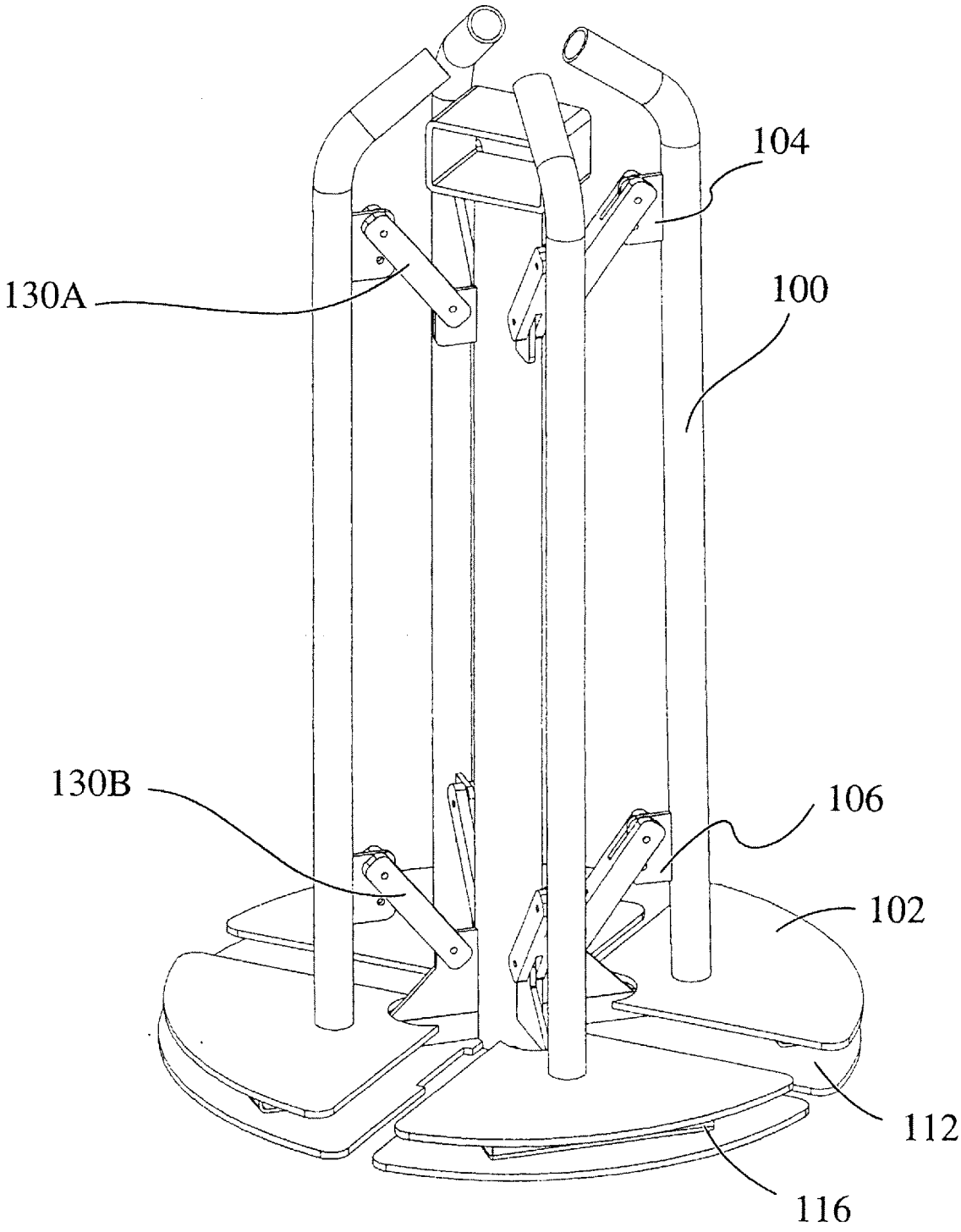
FIG. 7 is a depiction of the integrated spool of the present invention.
Figure 9:
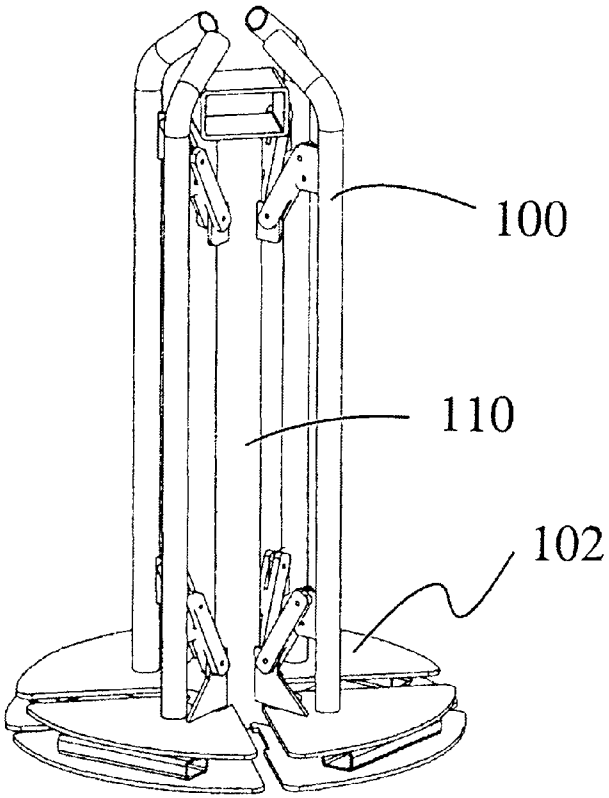
FIG. 9 is a depiction of the integrated core spool of the present invention in a collapsed position.
Figure 8:
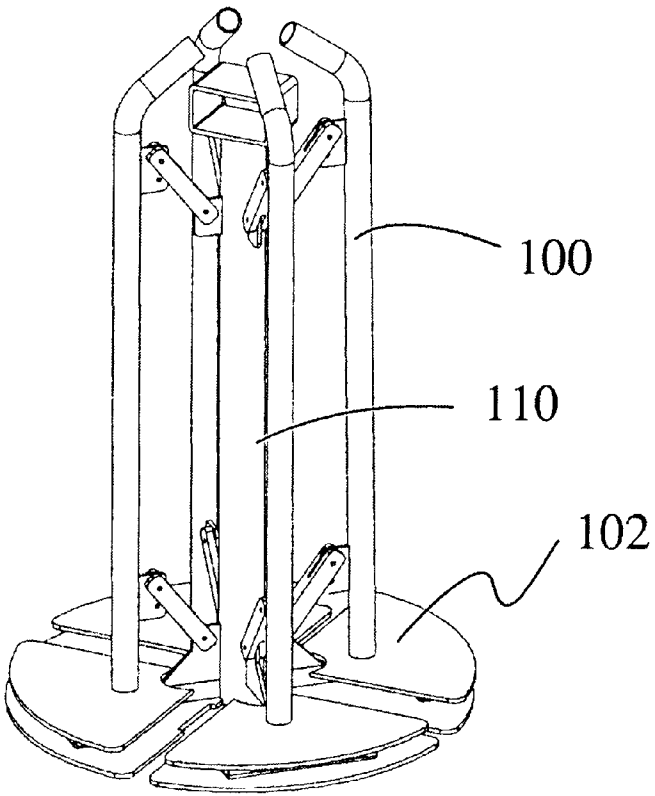
FIG. 8 is a depiction of the integrated carrying spool of the present invention in an expanded mode.

FIGS. 7–11 depict the collapsible carrying spool of the present invention. It is expandable and contractible in a radial direction as seen in FIGS. 8 and 9. In its expanded position, the spool tightens against the inside of the wire core for secure handling. In its contracted position the spool loosens from the inside of the core and is easily removed from the wire core. The spool is also designed to cooperate with the compressing and binding apparatus during binding of the wire core, as previously described.

Figure 10:
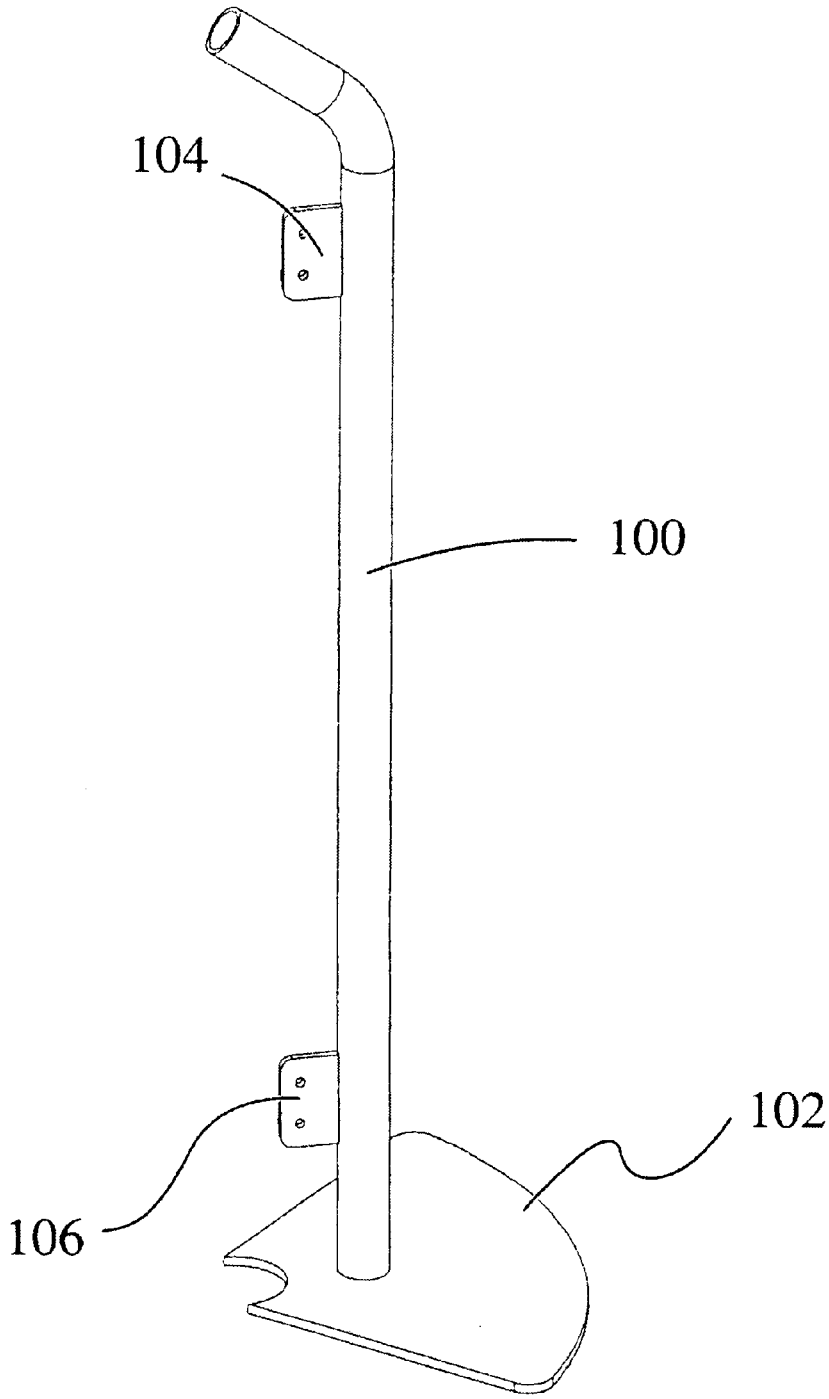
FIG. 10 is a depiction of a contact member of the spool of the present invention.

The collapsible carrying spool of the present invention is comprised of a plurality of expandable contact members, 100, seen individually in FIG. 10. In the herein described preferred embodiment, there are four contact members. Different numbers of contact members may be used. A vertical, expandable contact member is in the preferred embodiment a tube, although rods, bars, plates and the like may be used. Each expandable contact member, 100, is fixedly attached at its lower end to a base plate, 102. The base plate, 102, is wedge-shaped in the presently described preferred embodiment, the wedge corresponding to 90°. The base plate shape may be square or other shapes, provided that the assembled base plates have gaps between them for the binding wires to be drawn through while a wire core is on the spool and in the binding apparatus. The expandable contact member also has an upper boss, 104, and a lower boss, 106, on its inner aspect, each boss having at least one through hole. In the depicted preferred embodiment, an upper portion of the expandable contact member is angled inwards in order to prevent it catching on wire being placed on it or removed.

Figure 11:
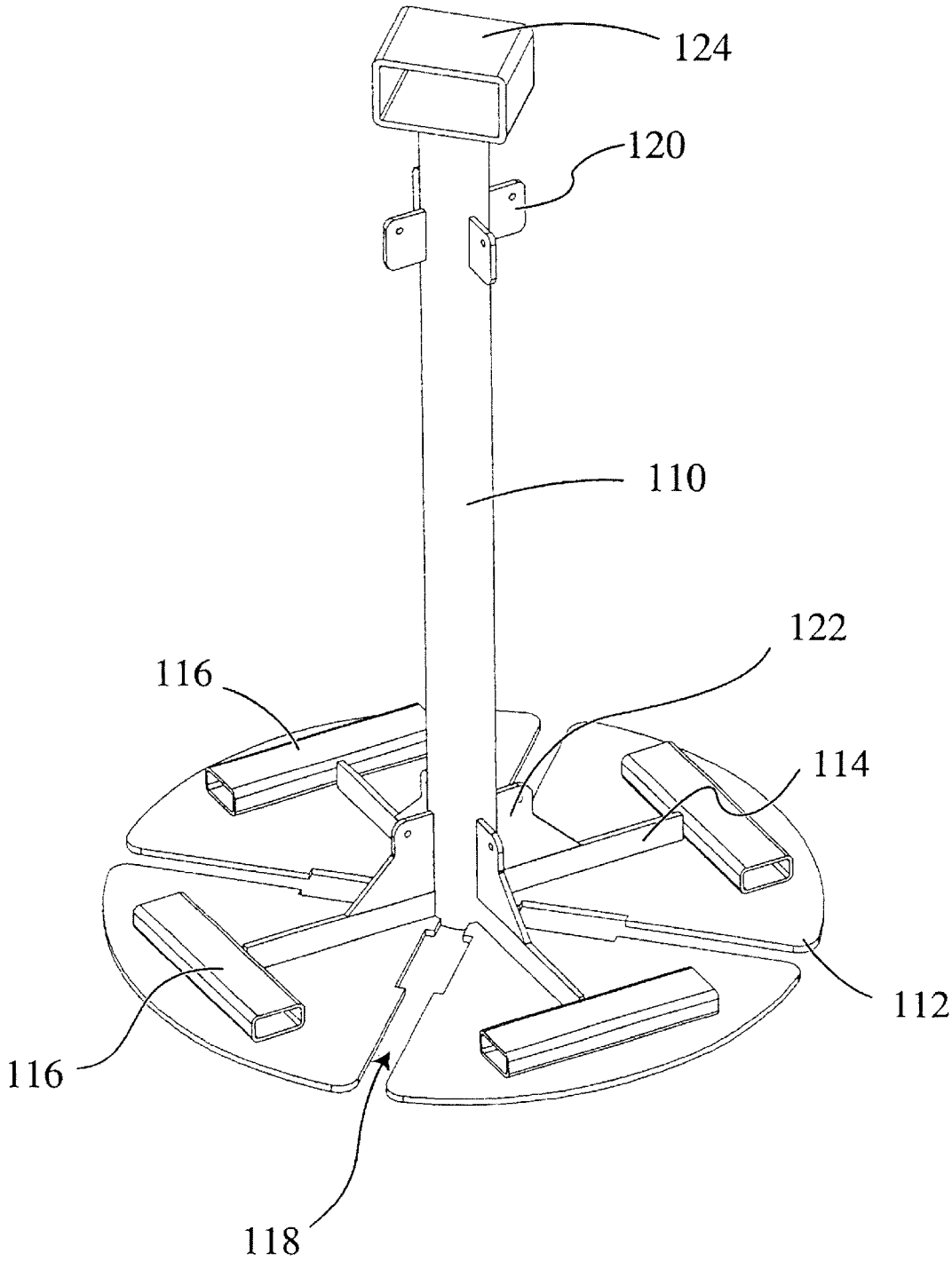
FIG. 11 is a depiction of the lower base member and axial lifting member of the wire core spool of the present invention.

FIG. 11 depicts the collapsible carrier spool central lifting member, 110, which is coaxial with the wire core. Fixedly attached to the bottom of the axial, central lifting member, 110, are four wedge-shaped stands, 112. Radial supports, 114, attach and strengthen the union between the stands, 112 and central lifting member, 110. Along with separators, 116, supports, 114, comprise a platform on which base plates, 102, may rest in one position while maintaining a vertical space between the base plates, 102, and stands, 112. Stands, 112, like the base plates, 102, are disposed such that a gap is maintained between adjacent stand members. The vertical contact members, 100, and their base plates, 102, will be disposed over the base stand members and in coordination with them such that the gaps between adjacent base plates, 102, and stands, 112, are parallel and aligned. The aligned gaps are a path through the spool for passage of a binding wire. In this manner, the gaps in the spool and table and the space between the compressor arms 32 form a path through the entire assembly through which a binding wire may be drawn tight against the wire core held by the spool. Gaps are apparent at 118. In a preferred embodiment these gaps are also wide enough to accommodate passage therethrough of binding wire guide tracks, 16A, 16B, 40A and 40B. In the depicted embodiment, the gaps widen near the axial central member 110 to accept insertion of the inboard portion of the guide tracks.

The central lifting member, 110, also has upper and lower bosses, 120 and 122, also each having through holes. The central axial member also has a handle, 124, for picking up the carrier spool and wire core with handling equipment such as fork trucks or lifting hooks.

Assembly of these components into the collapsible carrying spool is by means of eight expansion arms, seen in FIG. 7. Each of the eight expansion arms, 130A and 130B, are pivotally attached to the through holes in bosses, 104, 106, 120 and 122. Hence, the four upper expansion arms, 130A, have an inner end with a through hole pivotally attached to central lift member upper boss, 120, by means of a pin, bolt, rivet or other conventional pivoting fixation device. Each of the upper expansion arms, 130A, are also pivotally attached through similar pivoting fixation devices to the vertical contact members' upper bosses, 104.

Similarly, lower expansion arms, 130B are pivotally connected at their inner end to the central, axial lift member lower bosses, 122, and pivotally connected at their outer end to vertical expansion member lower bosses, 106.

The pivoting, actuate motion of the expansion arms, 130A and 130B, allow vertical contact members, 100, to move upwards and inwards in relation to central lifting member, 110, to reach a collapsed or contracted position. They also allow vertical members, 100, to move downward and outward in relation to central lifting member, 110, until their downward and outward motion is arrested by contact with supports, 114, and stops, 116, which is the expanded position.

It can be seen in FIGS. 8 and 9 that the upward motion of the vertical contact members, 100, moves the contact members, 100, closer together, narrowing their overall diameter as a group and taking them out of contact with a wire core inner surface. In this position the spool is "collapsed," facilitating removal of the core from the spool. When the vertical contact members, 100, are moved in a downward motion, the outward arcuate motion of the expansion arms, 130, expand the overall radius of the group of the vertical contact members, bringing each of them in contact with the inner surface of a wire core disposed on the spool. In this expanded position, the core is tightly secured to the spool during handling.

Outward expansion of the vertical contact members is actuated by the normal force of the weight of the wire core in a downward motion against the base plates, 102. The weight of the core may exert a force in combination with an opposite upward force on the central lifting member, 110, which force is applied by any of a variety of handling machines such as fork trucks or lifting hooks, which are engaged by an operator with handle, 124. Hence a secure, tight engagement with the wire core carried by the spool is directly established by the act of lifting the spool.

Correspondingly, the spool may be "collapsed" by a downward force on the central lifting member, 110, or an upward lifting force on the base plates, 102, or a combination of the two. The base plates, 102, are separated vertically from the base stands, 112, a sufficient distance for the forks of a fork truck to be inserted between them. This presents another option for transporting the wire core/spool assembly, or mounting the spool at a station where the wire core will be used. Station forks or lifting forks exerting upward pressure on base plates, 102, will narrow the contract members, 100, and loosen the wire core from the spool.

In view of the foregoing, it will be seen that the several advantages of the invention are achieved and attained.

The embodiments were chosen and described in order to best explain the principles of the invention and its practical application to thereby enable others skilled in the art to best utilize the invention and various embodiments and with various modifications as are suited to the particular use contemplated.

As various modifications could be made in the constructions and method herein described and illustrated without departing from the scope of the invention, it is intended that all matter contained in the foregoing description or shown in the accompanying drawings shall be interpreted as illustrative rather than limiting. For example, the apparatus and method of the present invention may be used to bind objects other than wire cores. Thus, the breadth and scope of the present invention should not be limited by any of the above-described exemplary embodiments, but should be defined only in accordance with the following claims appended hereto and their equivalents.

What is claimed is:

1. A wire core binder comprising:

a spool having at least one wire path;

a binding table to hold said spool, said binding table having at least one wire path;

a compressor that holds a wire core on said table during binding;

at least one guide track composed of sections, said at least one guide track having a closed position enclosing the wire core and an open position allowing ingress and egress of said spool to and from said binding table; and at least one tying head to bind the wire core with a binding wire, each of said tying heads being operatively engaged with one of said guide tracks;

said guide track guiding the binding wire to the wire core through said wire paths in said spool and said table.

2. The wire core hinder of claim 1 wherein said at least one tying head is movable between a first position engaged with at least one first guide track and at least one other position engaged with at least one other guide track.

3. An apparatus for binding a transportable wire core comprising:

a collapsible spool having a plurality of base plates being in spaced relation such that a binding wire can pass between said base plates;

a binding table comprised of a plurality of sections, said sections being in spaced relation sufficient to allow passage of binding wire between each of said sections;

a plurality of guide tracks, each of said guide tracks having a first section and a second section;

said first sections of said guide tracks being in operative alignment between said base plates of said collapsible spool and between said sections of said binding table;

said second sections of said guide tracks being translatable between a removed position and an engaged position that operatively engages said first sections of said guide tracks such that said second sections of said guide tracks operatively align between said base plates of said collapsible spool and between said sections of said binding table; and at least one tying head that loops binding wire around a the transportable wire core through said guide tracks, tensions the binding wire to release the binding wire from said guide tracks and to draw the binding wire between said base plates of said collapsible spool and into direct contact with the transportable wire core, cuts the binding wire, and knots the binding wire.

4. An apparatus for binding a transportable wire core comprising:

a binding table comprised of a plurality of sections, said sections being in spaced relation sufficient to allow passage of binding wire between each of said sections;

a spool having a plurality of stand members being in spaced relation sufficient to allow passage of binding wire between each of said stand members, said spool being positionable on said binding table such that said stand members of said spool and said sections of said binding table are aligned in operative cooperation;

a plurality of first sections of a plurality of guide tracks, said first sections being attached to said binding table, said first sections being operatively aligned between said stand members of said spool and between said sections of said binding table;

a frame, said frame being operatively aligned with said binding table;

a wire core compressor, said compressor being translatably engaged with said frame and movable between a first, removed position and a second position compressing the transportable wire core.

a plurality of second sections of said plurality of guide tracks, said second sections of said guide tracks being attached to said wire core compressor, said second sections being translatable between a removed position and an engaged position, said removed position being spaced from said binding table such that said spool may be positioned on said binding table, and said engaged position operatively engaging said first sections of said guide tracks such that said second sections of said guide tracks align between said sections of said binding table and said stand members of said spool; and at least one tying head attached to said frame, said at least one tying head having a driver that loops binding wire around a the transportable wire core on said spool through said guide tracks, a tensioner that tensions the binding wire to release the binding wire from said guide tracks, and draws the binding wire between said sections of said binding table and between said stand members of said spool, whereby the binding wire is brought into direct contact with the transportable wire core, a cutter that cuts the binding wire to a preconfigured length, and a knotter that knots the binding wire.

5. The apparatus of claim 4 wherein said spool further comprises:

a central lifting element attached to said plurality of stand members;

at least one expandable contact element, each of said expandable contact elements being attached to a base plate, said base plates being disposed over said stand members of said central lifting element;

said stand members and said base plates being disposed in spaced relation sufficient to allow passage of binding wire through said stand members and said base plates.

6. The apparatus of claim 4 wherein said tying head is moveable from a first position to at least one other position, said other position being in operative alignment with at least one second guide track.

7. The apparatus of claim 4 further comprising an entry conveyor, said entry conveyor having extendible arms to lift said spool holding an unbound wire core from said entry conveyor, deposit said spool onto said binding table and then retract.

8. The apparatus of claim 4 further comprising an exit conveyor, said exit conveyor having extendible arms to lift said spool holding a bound wire core from said binding table, deposit said spool onto said exit conveyor and then retract.

9. The apparatus of claim 4 wherein said spool further comprises:

a lifting element attached to said plurality of stand members;

at least one expandable contact member, each of said expandable contact members being attached to at least one base plate, each of said base plates being disposed over each of said stand members; and each of said stand members and each of said base plates being disposed in spaced relation such that during said enclosing of the wire core with said at least one guide track, each guide track is disposed in operative cooperation with said spool such that binding wire passes through said at least one base plate and through said at least one stand member.

10. The apparatus of claim 4 wherein said spaced relations of said at least one base plate and said spaced relations of said at least one stand member are aligned with said spaced relations between said sections of said binding table.

11. The apparatus of claim 4 wherein a bottom of said stand member has at least one locator pin.

12. The apparatus of claim 4 wherein a bottom of said stand section has at least one receptacle for receiving a locator pin.

13. The apparatus of claim 4 further comprising:

at least two of said base plates having substantially straight external edges that are substantially parallel, said substantially straight external edges being in preconfigured relation to internal edges of said base members that define said spaced relation of said adjacent base plates;

said stand members having at least two substantially straight external edges that are substantially parallel, said at least two substantially straight external edges being in preconfigured relation to internal edges of said stand members that define said spaced relation of said stand members; and said substantially straight external edges of said base plates and said substantially straight external edges of said stand members being dimensioned to fit in close sliding cooperation with side walls of an entry conveyor;

whereby said spaced relations of said base plates and said spaced relations of said stand members are alignable with spaced relations between sections of a binding table.

14. The apparatus of claim 13 wherein said substantially straight external edges of said base plates and said substantially straight external edges of said stand members are dimensioned to fit in close sliding cooperation with side walls of a binding table to align said spaced relations of said base members and said spaced relations of said stand members with said spaced relations of said sections of said binding table.

15. A method for binding a wire core comprising:

spooling the wire core on a spool having at least one wire path;

placing said spool on a binding table, said binding table having at least one wire path;

compressing said wire core on said binding table;

enclosing said wire core with at least one guide track;

binding said wire core with a binding wire along said guide track and through said wire paths of said spool on said table; and opening said guide track.

16. The method of claim 15 further comprising a second binding step wherein the binding wire is guided along at least one other guide track and through at least one other wire path through said spool and said table.

17. A method for binding transportable wire cores comprising:

placing a wire core onto a spool, the wire core being unbound, and said spool having at least one base plate being in spaced relation sufficient to allow passage of binding wire through said base plates;

conveying the wire core and said spool into a binding station;

compressing the wire core on said spool;

enclosing the wire core with at least one guide track, each guide track being disposed in operative cooperation with said spool such that each guide track guides a binding wire through said base plates;

binding the wire core while the wire core is on said spool, said binding step comprising;

looping at least one binding wire around the wire core through said at least one guide track;

tensioning said at least one binding wire such that said at least one binding wire is released by said guide track and brought into direct binding contact with the wire core;

cuffing said at least one binding wire to a predetermined length;

knotting said at least one binding wire;

removing said at least one guide track from said enclosure around the wire core;

releasing said compression on the wire core such that expansion of the wire core is restrained by said at least one binding wire; and taking the wire core on said spool out of said binding station.

18. The method of claim 17 wherein said conveying step comprises depositing the wire core and said spool onto a binding table comprised of a plurality of sections, said sections being in spaced relation sufficient to allow passage of binding wire between said plurality of sections.

19. The method of claim 17 wherein said placing step further comprises placing the wire core on a spool comprising:

a lifting element attached to at least one stand member;

at least one expandable element, each of said expandable elements being attached to one of said base plates, each of said base plates being disposed over each of said said stand members; and said at least one stand member and said at least one base plate being disposed in spaced relation such that during said enclosing of the wire core with said at least one guide track, each guide track is disposed in operative cooperation with said spool such that binding wire passes through said base plates and through said stand members.

20. The method of claim 17 wherein:

said spool has a lifting element attached to at least one stand member;

said spool has at least one expandable element, each attached to one of said at least one base plates, each of said at least one base plates being disposed over one of at least one stand members, said at least one stand members and said at least one base plates being disposed in spaced relation; and said spool is positionable on said binding table such that said base plates, said stand members and said plurality of sections of said binding table are aligned in operative cooperation whereby during said step of enclosing the wire core with said at least one guide track, each guide track is disposed in operative cooperation with said spool and said binding table such that when said binding wire is released by said at least one guide track, said binding wire passes through said base plates and through said stand members and through said plurality of table sections of said binding table.

21. The method of claim 17 wherein each of said spaced relations are aligned by at least one locator pin and at least one locator pin receptacle, said at least one locator pin being positioned on either a top surface of said plurality of table sections or a bottom surface of said at least one stand member, and said locator pin receptacle being positioned on the other of said top surface of said plurality of table sections or said at least one bottom surface of said stand members.

22. The method of claim 21 wherein said at least one locator pin is moveable between a retracted position and an extended position, said extended position being adapted to engage said at least one locator pin receptacle.

23. The method of claim 22 wherein said at least one locator pin is biased towards said extended position.

24. The method of claim 17 wherein said conveying step is executed by a conveyor belt, said conveyor belt having extendible arms to lift said spool from said conveyor belt, deposit said spool into said binding station and then retract.

25. The method of claim 17 wherein said conveying step further comprises the step of:

aligning said spaced relations of said stand members and said spaced relations of said base plates with said spaced relations of said sections of said binding table;

said base plates having at least two substantially straight external edges that are substantially parallel, said substantially straight external edges being in preconfigured relation to said spaced relations of said base plates;

said stand members having at least two substantially straight external edges that are substantially parallel, said substantially straight external edges being in preconfigured relation to said spaced relations of said stand members; and said substantially straight external edges of said base plates and said substantially straight external edges of said stand members being dimensioned to fit in close sliding cooperation with side walls of an entry conveyor;

whereby said spaced relations of said base plates and of said stand members are aligned with said spaced relations between said sections of said binding table.

26. The method of claim 17 further comprising;

moving a tying head after said binding step and before said removing step, said tying head having elements to execute said steps of looping, tensioning, cutting and knotting the at least one binding wire, said moving being from a first position operatively engaged with at least one first guide track to at least one additional position operatively engaged with at least one other guide track.

27. A method of transporting a wire core comprising:

disposing the wire core on a spool, said spool comprising:

a central lifting element having a top end and a bottom end, said top end being attached to a handle and said bottom end being attached to at least one stand member;

a plurality of expandable contact elements, each attachment at a bottom end to a base plate, each of said expandable contact elements having expansion arms attachment to said central lifting element such that said expandable contact elements expand outward from said central lifting element upon lifting if said central element, and such that said expandable contact elements move inward towards said central lifting element upon lifting of said base plates;

expanding said expandable contact elements of said spool to tighten against the wire core by lifting said handle of said spool; and transporting the wire core on said spool.

28. The method of claim 27 further binding the wire core while the wire core is on said spool.

29. The method of claim 27 further comprising a step of lifting the base plates to mover the contact elements of said spool inward such that said spool is loosened from contact with the wire core and removable from the wire core.

* * * * *

UNITED STATES PATENT AND TRADEMARK OFFICE

CERTIFICATE OF CORRECTION

PATENT NO. : 6,701,831 B2
DATED : March 9, 2004
INVENTOR(S) : Samuel E. Jones et al.

It is certified that error appears in the above-identified patent and that said Letters Patent is hereby corrected as shown below:

Column 15,
Line 4, "lifting the base plates to mover" should read -- lifting the base plates to move --

Signed and Sealed this

Fifth Day of April, 2005

JON W. DUDAS
*Director of the United States Patent and Trademark Office*